US011845521B2

(12) United States Patent
Santana Lima et al.

(10) Patent No.: US 11,845,521 B2
(45) Date of Patent: Dec. 19, 2023

(54) MARINE STRUCTURE COMPRISING A LAUNCH AND RECOVERY SYSTEM

(71) Applicant: USEA AS, Trondheim (NO)

(72) Inventors: Felipe Santana Lima, Fornebu (NO); Alex Alcocer Peñas, Kolsås (FR); Ole Petter Hjelmstad, Trondheim (NO)

(73) Assignee: USEA AS, Trondheim (NO)

( * ) Notice: Subject to any disclaimer, the term of this patent is extended or adjusted under 35 U.S.C. 154(b) by 278 days.

(21) Appl. No.: 17/278,552

(22) PCT Filed: Sep. 19, 2019

(86) PCT No.: PCT/EP2019/075180

§ 371 (c)(1),
(2) Date: Mar. 22, 2021

(87) PCT Pub. No.: WO2020/058408

PCT Pub. Date: Mar. 26, 2020

(65) Prior Publication Data

US 2022/0033042 A1 Feb. 3, 2022

(30) Foreign Application Priority Data

Sep. 21, 2018 (NO) ..... 20181231

(51) Int. Cl.
*B63G 8/00* (2006.01)
*B63B 21/20* (2006.01)
(Continued)

(52) U.S. Cl.
CPC ..... *B63G 8/001* (2013.01); *B63B 21/20* (2013.01); *B63B 27/08* (2013.01); *B63B 27/16* (2013.01);
(Continued)

(58) Field of Classification Search
CPC .... B63G 8/001; B63G 8/42; B63G 2008/004; B63G 2008/005; B63G 8/00; B63G 8/32;
(Continued)

(56) References Cited

U.S. PATENT DOCUMENTS 3,507,241 A * 4/1970 Annibale ..... B63B 27/36 114/259
6,883,453 B1 8/2005 Mulhern
(Continued)

FOREIGN PATENT DOCUMENTS

CN 104670434 A 6/2015
CN 104670440 A 6/2015
(Continued)

OTHER PUBLICATIONS

Notification of Transmittal of the International Search Report and the Written Opinion (Form PCT/ISA/220), International Search Report (Form PCT/ISA/210), and Written Opinion (Form PCT/ISA/237) for International Application No. PCT/EP2019/075180 dated Nov. 7, 2019, 13 pages.
(Continued)

*Primary Examiner* — Anthony D Wiest
(74) *Attorney, Agent, or Firm* — Withrow & Terranova, P.L.L.C.; Vincent K. Gustafson

(57) ABSTRACT

The present invention relates to a marine structure comprising a launch and recovery system for a submersible vehicle, and methods of operating the marine structure. The system comprises: a docking receiver, a towing head comprising a locking mechanism and being connectable to the docking receiver (13), a towing arrangement adapted to mechanically connect the towing head to the marine structure and being adapted to control the distance between the towing head and the docking receiver, and a lifting device connected to the docking receiver and being adapted to move the docking
(Continued)

Figure 1:
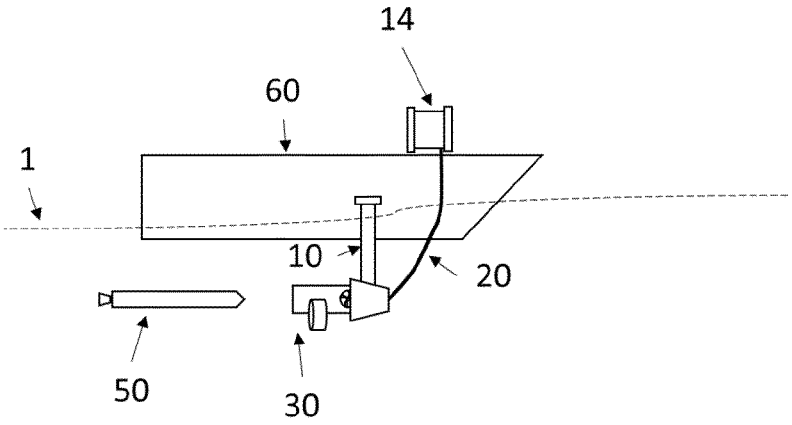

receiver relative to the marine structure. The lifting device can arrange the docking receiver in a towing head receiving and/or releasing position in which the docking receiver: (i) is completely submerged into the body of water, and (ii) is prevented from moving relative to the marine structure.

18 Claims, 4 Drawing Sheets

(51) Int. Cl.
*B63B 27/08* (2006.01)
*B63B 27/16* (2006.01)
*B63G 8/42* (2006.01)

(52) U.S. Cl.
CPC ..... *B63G 8/42* (2013.01); *B63B 2027/165* (2013.01); *B63G 2008/004* (2013.01); *B63G 2008/005* (2013.01)

(58) Field of Classification Search
CPC ..... B63B 21/20; B63B 27/08; B63B 27/16; B63B 2027/165; B63B 2003/147; B63B 21/00; B63B 21/66; B63B 27/00
See application file for complete search history.

(56) References Cited

U.S. PATENT DOCUMENTS

| | | | |
|---|---|---|---|
| 7,506,606 | B2 | 3/2009 | Murphy et al. |
| 7,581,507 | B2 | 9/2009 | Kern |
| 7,699,015 | B1 | 4/2010 | Said |
| 7,854,569 | B1 | 12/2010 | Stenson et al. |
| 8,336,479 | B2 | 12/2012 | Vosburgh et al. |
| 8,430,049 | B1 | 4/2013 | Tureaud et al. |
| 8,752,494 | B2 | 6/2014 | Soreau et al. |
| 8,881,665 | B2 | 11/2014 | Brizard et al. |
| 8,967,067 | B2 | 3/2015 | Soreau et al. |
| 9,180,940 | B2 | 11/2015 | Rikoski et al. |
| 9,359,046 | B2 | 6/2016 | Rosche |
| 9,453,705 | B2 | 9/2016 | Sylvia et al. |
| 9,517,821 | B2 | 12/2016 | Ford et al. |
| 9,708,035 | B1 | 7/2017 | Czepizak et al. |
| 9,778,388 | B1 | 10/2017 | Connor |
| 9,873,495 | B2 | 1/2018 | Stone et al. |
| 9,878,762 | B2 | 1/2018 | Pfuetzenreuter et al. |
| 10,232,915 | B2 | 3/2019 | Jourdan et al. |
| 10,259,549 | B2 | 4/2019 | Lambertus |
| 10,331,136 | B2 | 6/2019 | Perrone |
| 10,351,212 | B2 | 7/2019 | Jourdan et al. |
| 2010/0192831 | A1 | 8/2010 | Fournier |
| 2012/0160143 | A1 | 6/2012 | Bailey |
| 2013/0025521 | A1 | 1/2013 | Soreau et al. |
| 2016/0009344 | A1 | 1/2016 | Jourdan et al. |
| 2018/0079531 | A1 | 3/2018 | Bennett et al. |

FOREIGN PATENT DOCUMENTS

| | | | | |
|---|---|---|---|---|
| CN | 104986305 | B | 10/2015 | |
| CN | 105577514 | A | 5/2016 | |
| CN | 105775079 | A | 7/2016 | |
| CN | 106240772 | A | 12/2016 | |
| CN | 106956757 | A | 7/2017 | |
| CN | 107065882 | A | 8/2017 | |
| CN | 206644974 | U | 11/2017 | |
| CN | 107521639 | A | 12/2017 | |
| CN | 108528640 | A | 9/2018 | |
| CN | 210942195 | U | 7/2020 | |
| DE | 102012112333 | A1 | 1/2014 | |
| EP | 2043913 | A1 | 4/2009 | |
| EP | 2468620 | A1 | 6/2012 | |
| EP | 2739524 | A1 | 6/2014 | |
| EP | 2836422 | A1 | 2/2015 | |
| EP | 2838788 | A1 | 2/2015 | |
| FR | 2319570 | A1 | 2/1977 | |
| JP | 2015231779 | A | 12/2015 | |
| JP | 2017001637 | A | 1/2017 | |
| JP | 2017225272 | A | 12/2017 | |
| JP | 2018083558 | A | 5/2018 | |
| JP | 6443820 | B2 | 12/2018 | |
| JP | 6593771 | B2 | 10/2019 | |
| KR | 20160109087 | A | 9/2016 | |
| KR | 1742545 | B1 | 6/2017 | |
| KR | 1780803 | B1 | 9/2017 | |
| KR | 2079288 | B1 | 2/2020 | |
| SG | 10201602689 | A | 11/2017 | |
| WO | 2015049679 | A1 | 4/2015 | |
| WO | 2017086780 | A1 | 5/2017 | |
| WO | 2017211959 | A1 | 12/2017 | |
| WO | WO-2018069241 | A1 * | 4/2018 | ..... B63B 23/26 |
| WO | 2019207263 | A1 | 10/2019 | |
| WO | 2021069624 | A1 | 4/2021 | |

OTHER PUBLICATIONS

Norwegian Search Report for Norwegian Patent Application No. 20181231 dated Sep. 21, 2018, 2 pages.

Office Action (Communication Pursuant to Article 94(3) Epc) for European Patent Application No. 197730575 dated May 11, 2023, 5 pages.

* cited by examiner

MARINE STRUCTURE COMPRISING A LAUNCH AND RECOVERY SYSTEM

This application is a 35 U.S.C. § 371 national phase filing of International Application No. PCT/EP2019/075180, filed on Sep. 19, 2019 and claiming benefit of Norwegian Patent Application No. 20181231 filed on Sep. 21, 2018, wherein the disclosures of the foregoing applications are hereby incorporated by reference herein in their respective entireties.

FIELD OF THE INVENTION

The present disclosure relates to a marine structure according to the preamble of claim 1. Moreover, the present disclosure relates to a method for recovering a submersible vehicle to a marine structure. Further, the present disclosure relates to a method for launching a submersible vehicle from a marine structure.

BACKGROUND OF THE INVENTION

Manned and unmanned submersible vehicles have been extensively used in a broad variety of applications such as, but not limited to, seabed mapping, underwater surveillance, environmental monitoring, inspection of subsea infrastructure, etc. Unmanned submersible vehicles are commonly referring to either remotely operated (ROV—remotely operated vehicle) or autonomous (AUV—autonomous underwater vehicle), or towfish (cable-towed underwater vehicle) depending on their characteristics. Submersible vehicles typically can do the same work as divers, but at deeper waters, at higher speed, carrying more payload and without exposing human lives to all hazards present in the diving activities.

A key limitation of these submersible vehicles, especially the unmanned ones, is that they need a mother vessel to carry them offshore and to support their activities. ROVs need the mother vessel to carry them offshore, to launch them to the water, to recover them from the water and to provide connectivity at all times, typically through an umbilical cable. AUVs, as they do not need to be physically attached to their hosts, may eliminate the need for a mother vessel if its mission is very close to the coast or to fixed offshore facilities (e.g. an island, a platform, etc.). However, in most cases AUVs need a mother vessel to carry them offshore, to launch them to the water, to recover them from the water, to recharge their batteries periodically and to serve as a communication gateway (for data and positioning) while they are submerged.

The vessels that serve as mother vessels for submersible vehicles are typically much costlier than the submersible vehicles themselves. Moreover, because these vessels are relatively large and heavy, their propulsion systems typically produce large volumes of undesired emissions such as CO2 and NOX. Furthermore, their crews are exposed to all hazards inherent to offshore activities. Some of those hazards are particularly associated with the tasks of launching and recovering submersible vehicles from the water, as crew members are typically on the deck and exposed to moving bodies such as cranes, cables and the submersible vehicles themselves.

There is a need for a faster and safer launch and recovery system (LARS) for submersible vehicles, neither putting lives at risk, nor subjecting the vehicles and/or receiving device to hard handling.

There is further need for a LARS which can be operated by rougher sea than what existing solutions allow, limiting down-time under operations.

There is in particular a need to enable launch and recovery in a fully automated and/or unmanned manner. The submersible vehicles can be then operated from unmanned vessels, so called unmanned surface vessels (or simply USV), which can be much more affordable, smaller, safer and more environmentally friendly than conventional offshore vessels.

There is also a need to efficiently enable repeated missions by the submersible vehicles in a surveying campaign. At the end of a data surveying mission, the invention makes it easy for the submersible vehicles (in particular AUVs) to connect to the mother vessel, to reload battery while it downloads data from previous mission then uploads instructions for the next mission. This temporary connection allows numerous surveying missions during a surveying campaign, without having to bring the submersible vehicles onboard or onshore.

At the light of an increased use of submersible vehicles, there is also a need to optimise the use of a vessel mobilised for a campaign, manned or unmanned, in serving several submersible vehicles during a campaign. The vessel, manned or unmanned, may then carry several submersible vehicles to destination, launch them one after the other, then manage their respective missions and energy reload needs.

The closest prior art may be found in patent application US2016009344. It describes a towable receiving device comprising blocking means and a stop to secure the submersible vehicle to the device, the device including a plate to enable a smoother recovery on vessel via a ramp. Elevator fins (depth and trim) and a rudder (lateral offset) enable stabilisation of the assembly or the receiving device alone. The method of recovery may include a step of positioning the receiving device in an intercepting position, and interception can be made while sailing, with alignment of the routes of the submersible vehicle and the vessel.

Whereas the prior art solution enables connection of the submersible vehicle to the receiving device while sailing, at a few meters' depth, this ramp launch and recovery solution does not allow fast and safe operation, due to the many degrees of liberty of movement of the submersible vehicle-recovery device when being launched or recovered. In particular, it would not enable operations when the sea is rough. Further, it would not enable unmanned operations as the equipment, submersible vehicle, recovery device and vessel may be subjected to brutal and damaging operations when ramping up and down the recovery device, connected or not to the submersible vehicle, and operator direct control is required.

Moreover, whereas signal and power can be exchanged between submersible vehicle and recovery device in this prior art solution, no method is described to enable repeated missions in a survey campaign, thus limiting the number of time-consuming launch and recovery cycles. Furthermore, prior art solutions described would make awkward transport and operations of several submersible vehicle by a single vessel.

BRIEF SUMMARY OF THE INVENTION

In view of the above, an object of the present invention is to provide a marine structure comprising a launch and recovery system for a submersible vehicle which system enables the submersible vehicle being launched and recovered in a safe and time efficient manner, and by rough sea.

This objective is achieved by a marine structure according to claim 1.

As such, the present invention relates to a marine structure comprising a launch and recovery system for a submersible vehicle. The marine structure is adapted to be located in and/or by a body of water. The launch and recovery system comprises:

- a towing head comprising a locking mechanism adapted to lock the submersible vehicle to the towing head,
- a docking receiver, the docking receiver and the towing head being such that they can assume a connected condition in which the towing head is connected to the docking receiver,
- a towing arrangement adapted to mechanically connect the towing head to the marine structure, the towing arrangement being adapted to control the distance between the towing head and the docking receiver,
- a lifting device, wherein a first portion of the lifting device is connected to the docking receiver, the lifting device being adapted to move the docking receiver relative to the marine structure, According to the present invention, the lifting device is such that it can arrange the docking receiver in a towing head receiving and/or releasing position in which:

- the docking receiver is completely submerged into the body of water, and
- the docking receiver is prevented from moving relative to the marine structure.

By virtue of the marine structure according to the present invention, the procedure of connecting together the towing head and the docking receiver can be performed in the body of water, i.e. below the water surface. As such, the docking between the towing head and the docking receiver may be performed at a location at a distance from the so-called splash zone, close to the water surface, where large wave loads may occur.

Moreover, the feature that the docking receiver is prevented from moving relative to the marine structure when in the towing head receiving and/or releasing position implies an appropriately low risk of interference, e.g. clashing, between the marine structure and the submersible vehicle during the operation of connecting the towing head to the docking receiver.

Optionally, the lifting device is such that it is adapted to move the docking receiver from the towing head receiving and/or releasing position to a target position, associated with the marine structure, along a predetermined fixed trajectory relative to the marine structure.

As has been intimated above, a vertical range around the water surface, which range is generally referred to as the splash zone, is often associated with relatively large wave loads. Thus, the above feature of the lifting device, i.e. the possibility to move the docking receiver along a predetermined fixed trajectory, implies that the movement of the docking device through the splash zone may be performed in a safe and controlled manner. As such, the risk of damaging the submersible vehicle when raising it out of the body of water or when lowering it down into the body of water may be appropriately low. Similarly, the risk for operators, if on a manned structure, is low.

Optionally, the lifting device has a first extension along a first direction, wherein the lifting device is such that it enables movement of the docking receiver relative to the marine structure along the first direction and prevents movement of the docking receiver relative to the marine structure along a second direction, perpendicular to the first direction.

The possibility to prevent relative movement of the docking receiver relative to the marine structure along a second direction further implies a safe movement of the docking receiver, in particular through the splash zone.

Optionally, the lifting device comprises an articulated arm that is pivotable relative to the marine structure.

Optionally, the articulated arm is pivotable relative to the marine structure around a horizontally extending pivot axis.

Optionally, the lifting device comprises guide arrangement along which the docking receiver can be imparted a translational movement relative to the marine structure.

Optionally, the marine structure further comprises a loading/unloading station to/from which the submersible vehicle may be moved by the lifting device. Preferably, the loading/unloading station is located on a deck of the marine structure.

Optionally, the towing arrangement comprises a cable, preferably an umbilical.

Optionally, the towing arrangement comprises a cable management arrangement, preferably a winch, adapted to pull in and let out the cable, the cable management arrangement preferably being connected to the marine structure.

Optionally, the marine structure is a seagoing vessel adapted to float in the body of water.

Optionally, the submersible vehicle is an unmanned underwater vehicle, such as an autonomous underwater vehicle or a remotely operated vehicle.

Optionally, the locking mechanism is adapted to maintain the submersible vehicle connected to the towing head whenever the submersible vehicle is located in the body of water. Preferably, the submersible vehicle is a towfish.

A second aspect of the present invention relates to a method for recovering a submersible vehicle to a marine structure adapted to be located in and/or by a body of water. The method comprises:

- discharging a towing head from the marine structure such that it is located in the body of water, the towing head being mechanically connected to the marine structure via a towing arrangement;
- locking the submersible vehicle to the towing head;
- using a lifting device for arranging a docking receiver in a towing head receiving position in which position:
  - i. the docking receiver is completely submerged into the body of water, and
  - ii. the docking receiver is prevented from moving relative to the marine structure;
- operating the towing arrangement such that the submersible vehicle and the towing head are moved to the docking receiver such that the towing head and the docking receiver are connected to each other;
- using the lifting device for moving the docking receiver, the towing head and the submersible vehicle to an offloading position of the marine structure.

Optionally, the method may further comprise moving the submersible vehicle from the offloading position to a storage area on or within the marine structure.

It should be noted that the above features of the second aspect of the present invention need not necessarily be performed in the order listed above. Purely by way of example, the feature of arranging a docking receiver in a towing head receiving position may be performed before, simultaneous to, or after one or more of the following features:

- discharging a towing head from the marine structure such that it is located in the body of water, the towing head being mechanically connected to the marine structure via a towing arrangement;

locking the submersible vehicle to the towing head, and operating the towing arrangement such that the submersible vehicle and the towing head are moved to the docking receiver such that the towing head and the docking receiver are connected to each other.

A third aspect of the present invention relates to a method for recovering a submersible vehicle to a marine structure adapted to be located in and/or by a body of water. The submersible vehicle is mechanically connected to the marine structure via a towing arrangement. The method comprises:

using a lifting device for arranging a docking receiver in a submersible vehicle receiving position in which position:

i. the docking receiver is completely submerged into the body of water, and ii. the docking receiver is prevented from moving relative to the marine structure;

operating the towing arrangement such that the submersible vehicle is moved to the docking receiver such that the submersible vehicle and the docking receiver are connected to each other;

using the lifting device for moving the docking receiver and the submersible vehicle to an offloading position of the marine structure.

A fourth aspect of the present disclosure relates to a method for launching a submersible vehicle from a marine structure being adapted to be located in and/or by a body of water, the method comprising:

ensuring that the submersible vehicle is connected to a towing head;

connecting the towing head to a docking receiver at a loading position of the marine structure, wherein the docking receiver is connected to a first portion of a lifting device;

using the lifting device for moving the docking receiver, the towing head and the submersible vehicle from the loading position to a towing head launching position in which position:

i. the docking receiver is completely submerged into the body of water, and ii. the docking receiver is prevented from moving relative to the marine structure;

Optionally, the method according to the fourth aspect further comprises:

disconnecting the towing head from the docking receiver, and operating a towing arrangement such that the submersible vehicle and the towing head are moved away from the docking receiver.

Optionally, the method according to the fourth aspect further comprises:

disconnecting the submersible vehicle from the towing head.

As an option for the method according to the second, third or fourth aspect, the lifting device is such that it is adapted to move the docking receiver from the towing head receiving and/or releasing position to a target position, associated with the marine structure, along a predetermined fixed trajectory relative to the marine structure.

As an option for the method according to the second, third or fourth aspect, the lifting device has a first extension along a first direction, wherein the lifting device is such that it enables movement of the docking receiver relative to the marine structure along the first direction and prevents movement of the docking receiver relative to the marine structure along a second direction, perpendicular to the first direction.

As an option for the method according to the second, third or fourth aspect, the lifting device comprises an articulated arm that is pivotable relative to the marine structure.

As an option, the pivot rotates along a non-vertical axis, preferably horizontal.

As an option for the method according to the second or third aspect, the lifting device comprises guide arrangement along which the docking receiver can be imparted a translational movement relative to the marine structure.

FIGURES

FIG. 1: The complete system, LARS and submersible vehicle, in a typical operation situation FIG. 2: Operating the lifting device of the LARS, a lateral embodiment FIG. 3: A LARS alternative embodiment with a tower, well adapted to vessel including a moonpool FIG. 4: A schematic recovery sequence g—submersible vehicle approaching the towing head, h—submersible vehicle docked in the towing head, i—assembly pulled closer to docking receiver, j: assembly docked to docking receiver, and k: assembly moved over board of vessel FIG. 5: A towing head embodiment with a,b—two external thrusters and one integrated thrusters and, c—with four external thrusters and four fins FIG. 6: Schematic section of the assembly towing head—submersible vehicle FIG. 7: Communication alternatives between submersible vehicle, LARS, surface vessel, and headquarters FIG. 8: submersible vehicle with connection embodiment on the nose FIG. 9: Alternative towing head embodiment with clamping fingers, a-without submersible vehicle, b—with submersible vehicle docked FIG. 10: towing head, with clamping fingers used as a funnel to guide the submersible vehicle, approach sequence r-s-t.

DETAILED DESCRIPTION OF THE INVENTION

FIG. 1 illustrates an embodiment of a marine structure 60 according to the present invention. The FIG. 1 marine structure 60 comprises a launch and recovery system for a submersible vehicle 50. The marine structure 60 is adapted to be located in and/or by a body of water 1. The marine structure may be a ship, a barge, or any seafaring vessel. It may also be a static structure, such as an offshore platform. Or it may be a construction by a body of water, for example a harbour structure.

With reference to the figures, the launch and recovery system comprises:

a towing head 30 comprising a locking mechanism 32 adapted to lock the submersible vehicle 50 to the towing head 30, a docking receiver 13, the docking receiver 13 and the towing head 30 being such that they can assume a connected condition in which the towing head 30 is connected to the docking receiver 13, a towing arrangement adapted to mechanically connect the towing head 30 to the marine structure 60, the towing arrangement being adapted to control the distance between the towing head 30 and the docking receiver 13, a lifting device (10,15) wherein a first portion of the lifting device (10,15) is connected to the docking receiver 13, the lifting device 10 being adapted to move the docking receiver 13 relative to the marine structure 60.

Further, the lifting device (10,15) is such that it can arrange the docking receiver 13 in a towing head 30 receiving and/or releasing position in which:

the docking receiver 13 is completely submerged into the body of water 1, and the docking receiver 13 is prevented from moving relative to the marine structure 60.

The above discussed features of the present invention with be presented hereinbelow using illustrative non-limiting examples.

With reference to the figures, the system described in this invention is a marine structure exemplified as a surface vessel 60 with a launch and recovery system (LARS) for submersible vehicles, which may also be capable of supplying power from the said vessel 60 to the submersible vehicle 50 and transferring two-way data between the former and the latter.

The embodiment of the LARS described herein comprises four parts namely, referring to FIG. 1:

A lifting device 10,15 which is fixed to the vessel 60, with a cable management arrangement exemplified as a winch 14, and comprising or being capable of assuming a rigid connection with a docking receiver 13;

A towing arrangement exemplified as an umbilical cable 20 fixed at one end to the winch 14 and at the other end to the towing head 30;

A towing head 30 fixed to the termination of the umbilical cable 20;

The towing head 30 may be designed to co-apt with a connector 33 at the submersible vehicle 50, for example at the nose of the submersible vehicle, as exemplified at 52.

The vessel 60 sails, and water level is represented at 1.

Different from other LARS for submersible vehicles, this invention is based on a two-stage docking. The first docking stage being between the submersible vehicle 50 and the towing head 30 (illustrated as stage h in FIG. 4). The second docking stage is between the towing head 30 and the docking receiver (illustrated as stage j in FIG. 4).

Lifting Device 10

Figure 2:
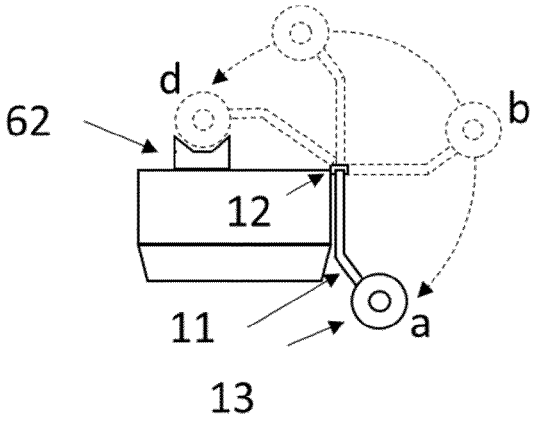

With reference to FIG. 2, a possible embodiment of the lifting device 10 may comprise an arm 11 with a hinge 12 fixed to the vessel 60 at one end and a docking receiver 13 at the other end. The hinge 12 can be fixed to any part of the vessel 60 such as the stern, bow, deck, side (as illustrated in FIG. 2) or a moonpool.

Purely by way of example, as indicated in FIG. 2, the articulated arm 11 may be pivotable relative to the marine structure 60 around a horizontally extending pivot axis. However, it is also envisaged that the pivot axis may extend in other directions in other implementations of the lifting device.

Figure 3:
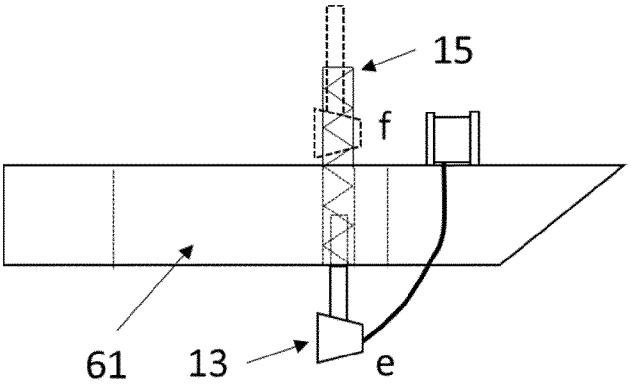

Alternatively, the lifting device may be a mechanism comprising more than one arm and more than one hinge, or yet a sliding mechanism, or any comparable embodiment that performs the same function. FIG. 3 illustrates an alternative implementation, where the docking receiver 13 is transferred between a submerged position s and a position on top t on the deck by a tower 15 fixed to the vessel's moonpool 61.

The fundamental function of the lifting device 10,15 is to move the docking receiver 13 between a towing head receiving and/or releasing position below the water surface [a, s] (i.e. submerged) and another position which can be above the water surface (FIG. 2 [b,c,d], FIG. 3 [f], on either direction, in a controlled movement. Regardless of the embodiment of the lifting device, the position of the docking receiver 13 relative to the vessel 60 is controlled at all times. In one embodiment, the lifting device is articulated, in other words made of a combination of rigid links, hinges, rotating platforms and/or slides, and not of flexible links (e.g. a cable) which might allow the receiver to move freely relatively to the vessel in one or more degrees of freedom. In another embodiment, the lifting device is a lift 15, see for example FIG. 3.

In some embodiments, the lifting device has the ability to lock in a position such that the docking receiver 13 is kept in towing head receiving position, i.e. submerged. With reference to FIG. 2, the lifting device 10 may have a locking device (e.g. a latch or similar) that can keep the articulated arm 11 in the low position [a]. Similarly, for a lift as illustrated in FIG. 3, the tower 15 may have a stop or similar that can keep the docking receiver 13 in the lowermost position [e].

In other embodiments, the lifting device has the ability to lock in an onboard position, as represented in FIG. 2 [d] or FIG. 3 [f].

The lifting device can thus carry the submersible vehicle, locked to the towing head and connected to the docking receiver to a loading/unloading station, such as a storage cradle 62, on the marine structure, or within it. It would be easy to design a storage area, covered or not, with one or more cradles, to store the submersible vehicle(s).

The docking receiver 13 may be positioned below the water (FIG. 2 [a], FIG. 3 [e], FIG. 4 [j]), by the lifting device 10, 15, for operations such as submersible vehicle launch, submersible vehicle recovery, submersible vehicle docking, wet towing of submersible vehicle, etc.

The docking receiver 13 can be placed in another position, not submerged, (possibly above the main deck, such as in FIG. 2 [d], FIG. 3 [f], FIG. 4 [k]) for operations such as, for example, transit.

The advantage of the docking receiver 13 being above the water in such operations is that drag forces are minimised, allowing the vessel 60 to move at higher speeds and at lower energy consumption. In addition, it may be easier to reduce tilting due to heavy unbalance on the vessel.

This discussion for the docking receiver do also apply to the towing head, and/or the submersible vehicle. During transit, having the towing head and the submersible vehicle above water, and preferably on deck or within the marine structure is preferable. In the case of the towfish, whereas the combined towing head-sensing part are towed, the docking receiver is preferably positioned above water.

With reference to FIG. 2 and FIG. 3, the docking receiver 13 is the part of the LARS that receives the towing head 30 when the umbilical cable 20 is pulled by the winch 14. The docking receiver 13 can be embodied, for example, as a simple plate or similar device with an opening for the umbilical cable 2 to pass through. The docking receiver 13 may be made in a shape that matches the shape of the towing head 30. As such, when the umbilical cable 20 is pulled by the winch 14, the towing head 30 is pulled towards the docking receiver 13 until they touch. At that point, if the shape of the docking receiver 13 matches the shape of the towing head, the latter may be secured to the former. For example, if the towing head has a conic nose 35, the docking receiver 13 may be a conic funnel. Thus, the umbilical cable 20 will pull the towing head's nose 35 into the funnel-shaped docking receiver 13, until they are safely secured. When the towing head 30 is docked to the docking receiver 13 driven by the umbilical cable 20 tension, an optional mechanical latch may be actuated to secure them together, so that the tension in the umbilical cable 20 can be released without releasing the towing head 30 from the docking receiver 13. Alternatively, instead of using a mechanical latch, the umbilical cable can be kept in tension as means of keeping the towing head 30 secured to the docking receiver 13. Other comparable solutions may be alternatively adopted to keep the towing head 30 secured to the receiver 13.

The lifting device 10, 15 may be equipped with other sensors and instruments and their data made available to the vessel or a remote control station, for example headquarters, using the vessel's satellite communication link. The lifting device can also be equipped with an ultrashort baseline (USBL) transceiver or other types of positioning systems. By placing an USBL transceiver on the lifting device 10, 15 rather than directly at the vessel's hull, several benefits arise. The transducer is submerged below the splash zone while in operation, which benefits the acoustic channel and the performance of the USBL positioning system. When not in use, the lifting device 10, 15 can be lifted above the water, protecting the transceiver. An ultrashort baseline (USBL) transceiver at the lifting device 10,15 can be used, for example, to obtain absolute position measurements of the towing head 30 and the submersible vehicle 50. Further information regarding sensing and data communication is provided further down, in connection with FIG. 7.

The cable management arrangement, exemplified herein as a winch 14, has several functions, including paying out the umbilical cable 20 in a controlled manner, pulling in the umbilical cable 20 in a controlled manner, and keeping the umbilical cable tidy (e.g. coiled around a shaft, drum or similar shape) onboard the vessel 60. The winch 14 can be fixed to the vessel 60, to the base of the lifting device or to any other structure onboard the vessel 60. Furthermore, the cable management may be equipped with an active compensation function, such that the vessel motions, especially heave and surge, are not directly transferred to the towing arrangement and consequently to the towing head 30.

Towing Arrangement 20

Figure 4:
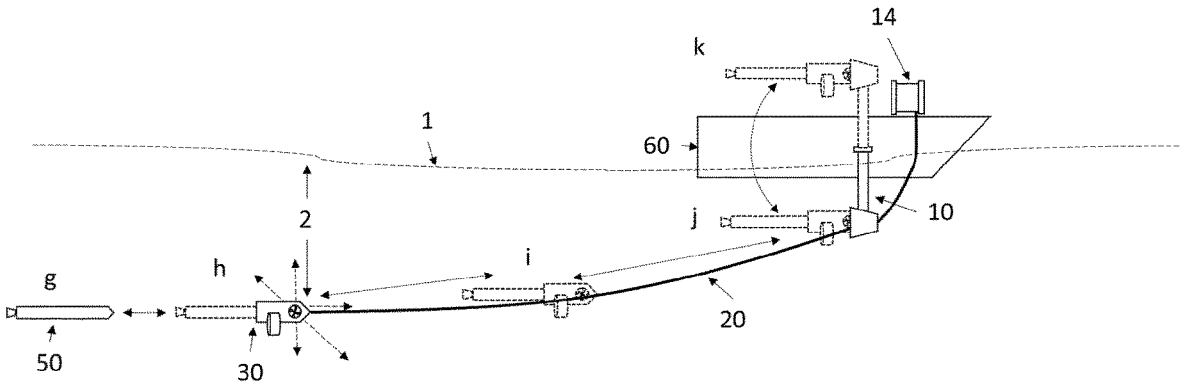

FIG. 4 illustrates an umbilical cable 20 as a possible embodiment of the said towing arrangement. In this particular embodiment, it is a cable designed to withstand tension and to provide services such as electric power, data transfer between the vessel 60 and the towing head 30, and possibly other services such as hydraulics. It may be a bundle of one or more wire ropes (to withstand tension), isolated conductors (to transmit power and communication), possibly hydraulic tubes (for the control functions in the towing head 30) and possibly optic fibres (for broader bandwidth communication), all preferably protected with an external sheath. The umbilical cable 20 is terminated at the winch 14 at one end, which in turn is fixed directly or indirectly to the vessel 60, and at the towing head 30 at the second end. As an alternative to the schematic representations, the umbilical cable 20 may run through guides mounted to the lifting device and through the docking receiver 13. In that alternative, there would thus not be any exposed umbilical in the water between the winch 14 and the docking receiver 13.

Because the umbilical cable 20 has multiple functions, it may alternatively be implemented as multiple cables, not bundled in one single cord as described above. As an example, an alternative implementation might be a tension cable, a power cable and a communications cable, all independent from each other.

Towing Head 30

The towing head 30 is the part of the system that physically docks to the submersible vehicle 50 and effectively provides power communication connectivity between the submersible vehicle 50 and the vessel 60 through the umbilical cable 20. Therefore, the primary function of the towing head 30 is to mechanically connect and disconnect with the submersible vehicle 50. A second function that the towing head 30 may perform is to exchange power and data with the submersible vehicle 50.

The towing head 30 illustrated in FIG. 4 is fixed to the end of the umbilical cable 20. Therefore, when the docking receiver 13 is in submerged position and the umbilical cable 20 is paid out, the towing head 30 is dragged through the water, i.e. towed. Thus, it can be dragged through the water without the submersible vehicle 50 docked to it (such as in FIG. 1) or with the submersible vehicle 50 docked to it (such as in FIG. 4 [h,l,j]). For instance, it can be dragged through the water without the submersible vehicle 50 just after submersible vehicle launch (FIG. 1) or before docking operation (situation illustrated in FIG. 4 [g]). It can be dragged with the submersible vehicle 50 docked to it (FIG. 4 [h,i,j]) while the submersible vehicle's batteries are being recharged, when the submersible vehicle is downloading or uploading data, when the submersible vehicle is about to be recovered or yet when the submersible vehicle is to be wet towed for any other reason.

In the case of a towfish, the towing head may be an integral part of the towfish, easily separated from a sensing part, and thus enabling flexibility in changing the sensing part of the towfish for example, or not.

Figure 6:
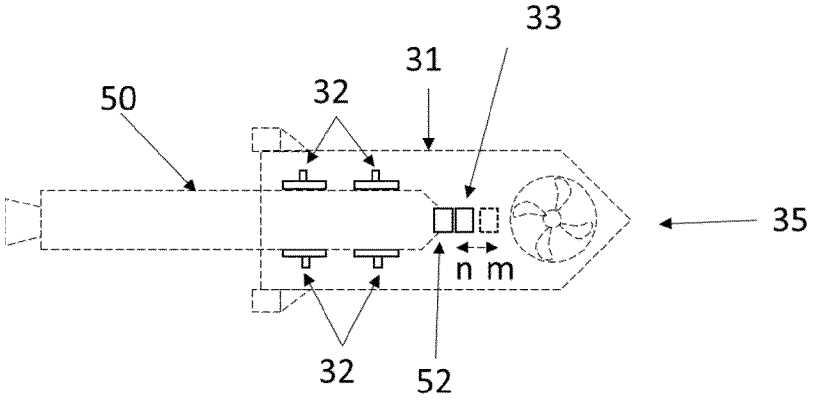
Figure 9A:
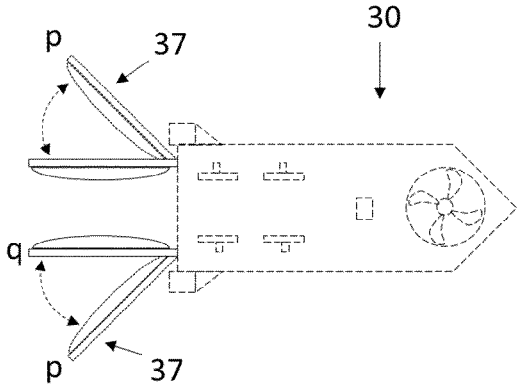
Figure 9B:
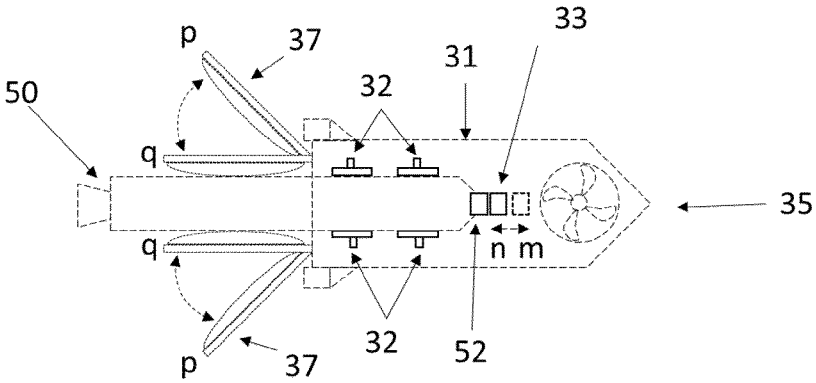
Figure 10:
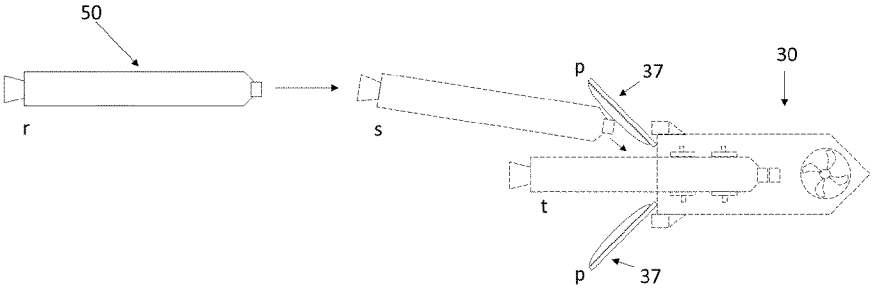

The towing head 30 illustrated in FIG. 6, FIG. 9 and FIG. 10 is capable of exchanging power and data directly with the submersible vehicle 50, when both are docked, without the need for the latter being taken out of the water. Thus, in an offshore campaign that requires the submersible vehicle 50 to be recharged and data uploaded/instructions downloaded multiple times, the submersible vehicle 50 does not need to be recovered multiple times to the vessel 60. Instead, docking the submersible vehicle 50 to the towing head 30 is sufficient.

FIG. 4 illustrates an embodiment of a method for recovering a submersible vehicle 50 to a marine structure 60.

As indicated in FIG. 4, the method comprises:

- discharging a towing head 30 from the marine structure 60 such that it is located in the body of water 1, the towing head 30 being mechanically connected to the marine structure 60 via a towing arrangement 20;
- locking the submersible vehicle 50 to the towing head 30;
- using a lifting device 10 for arranging a docking receiver 13 in a towing head 30 receiving position in which position:
  - i. the docking receiver 13 is completely submerged into the body of water 1, and
  - ii. the docking receiver 13 is prevented from moving relative to the marine structure 60;
- operating the towing arrangement 20 such that the submersible vehicle 50 and the towing head 30 are moved to the docking receiver 13 such that the towing head 30 and the docking receiver 13 are connected to each other;
- using the lifting device 10 for moving the docking receiver 13, the towing head 30 and the submersible vehicle 50 to an offloading position of the marine structure 60.

In embodiments in which the submersible vehicle 50 is adapted to be connected to the towing arrangement 20 whenever the submersible vehicle is located in said body of water 1, such as in embodiments in which the submersible vehicle 50 is a towfish, the first two steps in the above method, see also the steps indicated by the letters g and h in FIG. 4, may be omitted.

Figure 5A:
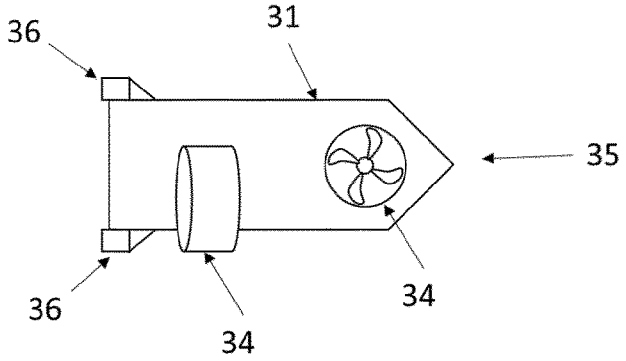
Figure 5B:
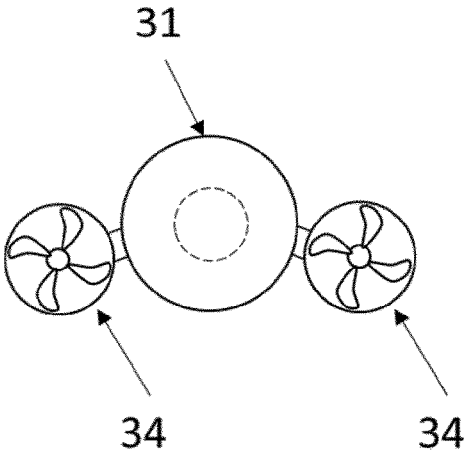

With reference to the embodiment illustrated in FIG. 5 and FIG. 6, the towing head 30 may comprise five key elements, namely body 31, locking mechanism 32, connector(s) 33, active depth and steering control 34 and final docking support system 36. The below description of this embodiment is an example of a possible physical solution.

The body 31 of the towing head is its main structural part, to which all other parts are assembled. In this particular embodiment it is a slender cylindrical body in order to streamline its hydrodynamic behaviour when the towing head 30 moves through the water, but essentially the body can be built in any alternative shape.

The locking mechanism's 32 main function is to secure the submersible vehicle 50 when the submersible vehicle is docking to the towing head 30 (FIG. 6). The locking mechanism 32 may be a set of "shoes" (in one embodiment not fewer than three) mounted in the towing head which, driven by a set of actuators, press radially the body of the submersible vehicle 50, holding it in place by friction. In an embodiment, the surfaces of the locking mechanism 32 that touch the submersible vehicle 50 can be in a material that is "softer" than the submersible vehicle body's material and that provides a high friction coefficient, such as, for example, profiled rubber. This way, when the submersible vehicle 50 docks to the towing head 30 and the locking mechanism "closes" to secure the submersible vehicle in docked position as illustrated in FIG. 6, the soft material may prevent the submersible vehicle from being damaged. When the moving parts of the locking mechanism 32 close into their counterparts on the submersible vehicle body, the friction coefficient of said material may also prevent the submersible vehicle body from sliding out of its docked position.

In one embodiment, a connector 33 is mounted to or integrated in the towing head 30. This connector transfers electric power and communications of data. In one embodiment, an inductive connector is preferred, because it does not leave any conductor exposed to the sea water at any point in time. It also does not depend on tight physical contact between two conductors, which might be difficult to achieve in some occasions. Instead, with an inductive connector, electric power and data can be transmitted between the two halves (one at the towing head 33 and the other at the submersible vehicle 52) whose electric cores are sealed from the marine environment. Thus, when the submersible vehicle 50 is docked to the towing head 30, the connector half at the towing head 33 is aligned with the connector half on the submersible vehicle 52 (FIG. 6). Further, in order to optimise communication by bringing the two connectors at short distance, the connector at the towing head 33 may optionally be equipped with a linear actuator, such that it can be actively moved towards its counterpart at the nose of the submersible vehicle (from [m] to [n] indicated in FIG. 6).

The said connector may, alternatively, be embodied as a set of separate connectors. For example, it may be implemented with one connector for power and one connector for data. Furthermore, instead of inductive connector, conductive connectors may be used, although this is not considered optimal for this application. Yet another alternative is to use an optical connector to transfer data between the towing head and the submersible vehicle. Yet another variation of this is to use optical transmitters and receivers on the towing head 30 and on the submersible vehicle 50 to transfer data.

Alternative solutions can be designed for locking a sensing part of a towfish to the towing head. As no release nor recovery are required underwater, the locking mechanism can be any solution which can be actuated for example in a loading/unloading station, such as a storage or loading/unloading cradle 62, on or in the marine structure.

With reference to FIG. 5, active depth and steering control of the towing head can be achieved by a set of fins 37,38, thrusters 34 or a combination of both. One of the functions of these fins 37,38 and/or thrusters 34 are to stabilise the forward-motion of the towing head when it is moving in the water and to actively control the dive and climb of the towing head in the water medium. In order to actively control the depth of the towing head in motion, the horizontal fins 38 (if present) may have active pitch angle control. In other words, the angle between the plane(s) formed by the fins 38 surfaces and the centreline of the towing head body 31 can be actively controlled. The same can be achieved with thrusters 34 that exert a component of thrust in the vertical direction. In the configurations illustrated in FIG. 5, this can be achieved by controlling the angle formed between the thruster shafts (which result in the thrust force vector direction) and the towing head's centreline, resulting in a vertical thrust component. The horizontal fins 38 and/or the thrusters 34 can also counteract the upward force exerted by the umbilical cable 20 on the towing head 30.

Figure 5C:
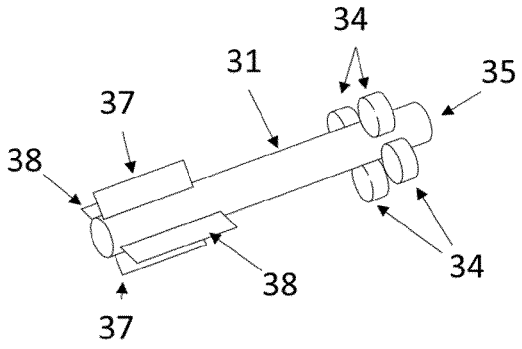

Steering may be achieved with a set of thrusters that exert lateral thrust. One or more such thrusters may be located at the fore end of the towing head. FIG. 5*a* illustrates such thruster integrated in the towing head body. An alternative implementation is with thrusters 34 fixed to towing head, external to its body, as illustrated in FIG. 5*c*. In that configuration, steering can be achieved by controlling the angle formed between the thruster shafts (which result in the thrust force vector direction) and the towing head's centreline, resulting in a lateral thrust direction. Optionally, vertical fins 37 can be placed at the fore or aft end of the towing head, above or below the area designated for submersible vehicle docking, as illustrated in FIG. 5*c*.

Figure 7:
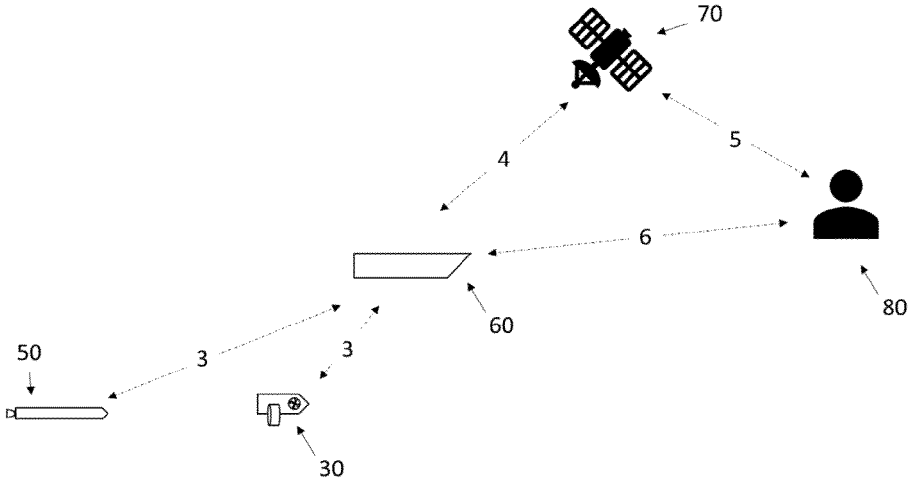

Regardless of how the active depth and steering control is physically embodied (i.e. with fins, thrusters, combination of both, or other solutions), it is an advantage, although not mandatory, that the system contains such function. The first reason why this function is desirable is that the deeper the submersible vehicle 50 docks to the towing head 30, the easier the docking operation becomes. This is because the hydrodynamic loads from waves acting on the towing head and on the submersible vehicle are strongest at the water surface and gradually decrease in intensity as vertical distance below the surface increases. The second reason why this function is desirable is that this solution requires less or no manoeuvring by the submersible vehicle 50 in the docking phase. The submersible vehicle can keep a constant course at a fixed depth and ideally at low speed, while the vessel together with actively controlled towing head manoeuvre to perform the final approach towards the nose of the submersible vehicle and complete the docking procedure. This in turn implies a much simpler integration with commercial submersible vehicle control systems, as the only task of the submersible vehicle is to keep a constant course and depth, a function readily available in most submersible vehicles. The difficulty of this docking stage is then transferred from the submersible vehicle 50 to the actively controlled towing head 30. Furthermore, provided that the vessel 60 is equipped with a broadband satellite communication link, this solution makes it possible to have a fully remotely operated docking procedure, in which a remote human operator 80 commands the vessel 60 and towing head 30 via a satellite link 70 (FIG. 7 illustrates an example of a communication architecture), assisted by the visual support system 36 of the towing head, and the relative positions of the submersible vehicle 50 and the towing head 30 as obtained by, for example, an USBL type of positioning system. This could be achieved, for example, with an USBL transceiver fixed to the vessel 60 (e.g. directly to the hull or to the lifting device 10), a transponder at the towing head 30 and another transponder at the submersible vehicle 50 (note: many commercial submersible vehicles are already equipped with an USBL transponder). In such configuration, both transponders at the submersible vehicle and towing head respectively can communicate on underwater acoustic signals 3 with the transceiver located at the boat or lifting device, as illustrated in FIG. 7.

The guiding support system's 36 function (see FIG. 5), if present, is to provide information of the submersible vehicle's 50 position relative to the towing head 30, especially during final approach and docking. Using the said system, the remote operator (or an automated controller) can control the towing head 30 (using its depth and steering control 34, 37, 38) to align with the submersible vehicle for an optimal docking. in one embodiment, this system may comprise one or more underwater cameras that stream the video feed to a remote control station 80, using the vessel's satellite communication link (FIG. 7). The towing head's guiding support system 36 can also be implemented with other types of sensors and instruments such as an imaging sonar, and their data made available to the remote control station in the same manner (FIG. 7).

The tail part of the towing head may, optionally, be equipped with an external guide, such as a grid that forms a funnel shape. In one embodiment, a gridded construction may be preferred to a funnel made of a continuous surface (for example a rolled plate), because it allows water to flow between its voids, reducing drag force. This type of guiding funnel can be found in some types of stationary docking stations for submersible vehicles. Yet another variation of this guiding funnel, not found in stationary docking stations or other LARS concepts, is a set of articulated "fingers" 37 (FIG. 9), envisaged to be approximately six (but a larger or smaller number is also possible and does not affect the principle). These fingers 37, when in "open" position (FIG. 9, position [p]), make a large angle with the centreline of the towing head 30, envisaged to be between 30 degrees and 60 degrees (but any other angle larger than 0 degree and smaller than 90 degrees is also possible and do not affect the principle). In that configuration, the fingers 37 altogether form the shape of a funnel facing the rear of the towing head. In "open position" they altogether serve as a guide, causing the same effect as the said gridded funnel, i.e. leading the nose of the submersible vehicle 50 to the centre of the rear part of the towing head 30 prior to docking (this guiding principle is illustrated in FIG. 10, where the submersible vehicle makes the transition from position [r]—before touching the fingers—through [5]—being guided by the fingers—to [t]—docked). When they are in "closed" position (FIG. 9, position [q]), they make a zero or close to zero-degree angle with the centreline of the towing head 30. Thus, these fingers "grab" the body of the submersible vehicle 50 when it is docked to the towing head 30, thus securing it in place. Unlike many other LARS concepts where the submersible vehicle enters a passive funnel, these grabbing fingers act as an active funnel that guide the submersible vehicle when in open position and gradually close radially towards the submersible vehicle body. In an embodiment, the parts of the grabbing fingers that touch the submersible vehicles may be in a material that both absorbs shock energy and provides a high friction coefficient, such as rubber. This way, when the submersible vehicle 50 is approaching the towing head 30 and bumps against the grabbing fingers at open position (FIG. 10 position [s]), the material may prevent damage, and when the grabbing fingers 37 press the submersible vehicle 50 radially (FIG. 9*b* position [q], the friction coefficient of said material may prevent the submersible vehicle's body from sliding out of its docked position.

In the case where the marine structure is static, such as an offshore platform or a harbour construction, it is the underwater streams which may create the drag enabling the paying out of the towing head. Alternatively, a static marine structure may have a module that moves relative to the water, such as, for example, a skid that moves along a rail fixed to an offshore platform, a harbour construction or any fixed structure.

Connector at the Nose of the Submersible Vehicle 52

Figure 8:
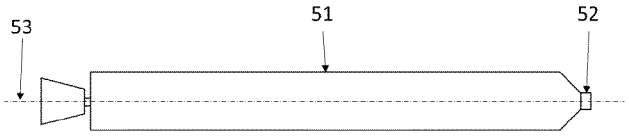

As illustrated in FIG. 8, a connector 52 may be mounted at the submersible vehicle 50. If present, this is the counterpart to the connector-half mounted to the towing head 33. in one embodiment, this connector 52 is envisaged to be concentric with the submersible vehicle's body 51, and located at the forefront of it, in the area typically called "submersible vehicle's nose" (FIG. 8). In other words, the connector centreline coincides with the submersible vehicle's centreline 53. This may ensure that, when the submersible vehicle 50 docks to the towing head 30, for example when the towing head's locking mechanism closes and secures the submersible vehicle in docked position, the connector 52 at the nose of the submersible vehicle aligns with its counterpart 33 at the towing head regardless of the final roll angle between the submersible vehicle 50 and the towing head 30 (FIG. 6). This may optimise performances of the power and/or data exchanges.

Storage of Submersible Vehicles on Board the Vessel

FIG. 2 represents an optional embodiment comprising a cradle 62 for safe storage of a submersible vehicle 50 onboard the vessel 60. The present invention enables the management and simultaneous operation by the mother vessel 60 of several submersible vehicles 50. Several cradles 62 can be built in the mother vessel, which the lifting device 10 may directly reach. As an alternative, a built-in transfer system may manage a storage of submersible vehicles with an additional internal moving solution (rollers, or cranes, etc . . . ), and present the required submersible vehicle on the dedicated launch and recovery cradle 62.

This embodiment is particularly favourable to unmanned operation. Managing a storage of several submersible vehicles automatically is not technically challenging (many solutions have been designed on platforms for the management of drilling tubes), and the adapted mother vessel would still be of advantageous size and economical construction and operation. A vessel with several submersible vehicles on board may also be advantageous even if operating only one submersible vehicle at a time. Should the operated submersible vehicle show some deficiencies beyond easy and fast (or unmanned) repair, it could efficiently be substituted by the other submersible vehicle in storage, thus avoiding having to sail back to harbour to collect a spare submersible vehicle.

The lifting device 10 may bring the submarine vehicle, optionally with towing head and docking receiver, directly to the storage.

Communication Resources

FIG. 7 outlines an embodiment of a data communication architecture. Communication between the submersible vehicle 50 and the vessel 60 can be achieved on acoustic transmissions, using, for example, a USBL system in which the submersible vehicle 50 contains a transponder and the vessel 60 contains a transceiver. Communication between the towing head 30 and the vessel 60, can be achieved in a similar arrangement, with a transponder mounted to the towing head 30 communicating with a transceiver mounted to the vessel 30. Both acoustic communication links 3 are envisaged to be used, primarily, for positioning, but can also be used for data transfer between both. Commercially available acoustic links typically provide narrow bandwidth with low bit rate but can support communication such as simple commands and system diagnostics reporting. With such arrangement, both the submersible vehicle's 50 position and the towing head's 30 position relative to the vessel 60 can be monitored. Both the submersible vehicle's 50 position and towing head's 30 position relative to the vessel 60 being known, the submersible vehicle's 50 position relative to the towing head's 30 position can be inferred. This is a valuable measurement for assisting the procedure of docking the submersible vehicle 50 to the towing head 30.

For establishing communication between the vessel 60 and the operator 80, assumed to be positioned outside the vessel 60 at a remote location, two options are anticipated. The first option is through a satellite 70, such that the vessel 60 communicates with the satellite 70 on electromagnetic transmissions 4 and the satellite 70 communicates with the operator 80 on any type of established network 5, such a, for example, internet. An alternative to the above is a communication link between the vessel 60 and the operator 80 without using a satellite 70, also on electromagnetic transmission 6. This can be achieved, for example, with point-to-point radio transmission, or using a cellular (e.g. 4G or 5G) network.

With the above communication links 3,4,5,6 established, in addition to the umbilical cable 20 which may also constitute a communication link, the towing head 30, the submersible vehicle 50, the vessel 60 and the operator 80 can communicate and exchange data with each other. Typical data transmitted by the submersible vehicle 50 is its position, underwater data collected by its sensors and system diagnostics reporting. Typical data received by the submersible vehicle 50 is commands and command sets for a mission. Typical data transmitted by the towing head 30 is its position and any real-time data collected by its sensors, cameras, etc. When the submersible vehicle 50 is docked to the towing head 30, the latter may also serve as a communication gateway between the submersible vehicle 50 and the vessel 60. The vessel may thus serve, primarily, as a communication gateway between the towing head 30, submersible vehicle 50 and operator 80. The vessel 60 may also generate data from its own sensors and send to the operator 80, as well as receive commands from the operator 80. This data communication architecture provides real-time situation awareness to the operator 80, transfers all the underwater data collected by the submersible vehicle 50 to the vessel 60 and to the operator 80 and transfers commands and command sets originated by the operator 80 to the vessel 60, to the submersible vehicle 50 and to the towing head 30.

Not represented in FIG. 7, though present at different locations, are commodity equipment such as servers for storage, communications, computations etc . . . .

Methods for Launch and Recovery

The methods for operating this invention differ from the known methods, primarily, by the fact that launch and recovery are achieved by a two-stage undocking and docking process, respectively. One stage is between the submersible vehicle 50 and the towing head 30 and the other stage is between the towing head 30 and the lifting mechanism 10. Both docking and undocking stages happen under the water surface, and onboard when mobilising or bringing back the submersible vehicle after operations, at loading or unloading. Both stages must be docked for the submersible vehicle 50 (along with the towing head 30) to be moved through the splash zone (i.e. between positions [j] and [k] in FIG. 4). However, it is possible to do some operations when only one docking stage is secured. Some of the operations that require only the submersible vehicle 50 to be docked to the towing head 30 include, for example, wet tow of the submersible vehicle, wet recharge of the submersible vehicle batteries and wet data exchange with the submersible vehicle.

Assuming that the submersible vehicle 50 is at a given point in time docked to the towing head 30, the towing head 30 is docked to the docking receiver 13, and they are all above the water (for example in FIG. 4, position [k])—which is the typical system status at the beginning of an offshore campaign when the system transits from the harbour to the offshore site—a submersible vehicle launch operation according to the present invention can be described as follows, with reference to FIG. 4:

1. The lifting device 10 moves the docking receiver 13 from a position above the water surface 1 to under the water surface. Because the towing head 30 is, at this point, docked to the docking receiver 13 and the submersible vehicle 50 is docked to the towing head 30, both the towing head 30 and the submersible vehicle 50 will move from the air to the water medium together with the docking receiver 13 (transition from position [k] to [j] in FIG. 4).
2. If the docking receiver 13 is equipped with a mechanical lock, which is not mandatory, and this lock is at locked position, the lock is then switched to unlocked position.
3. The system may then start to pay out the umbilical cable 20. This is achieved by turning the winch 14 in a controlled manner. Driven by drag force acting on the submersible vehicle 50, on the towing head 30 and on the umbilical cable 20 itself as these are towed through the water medium by the moving vessel 60 (ideally at low speed), the distance between the docking receiver 13 and the towing head 30 (with the submersible vehicle 50 docked to it) gradually increases. (This step is the transition from position [j] through [i] to [h] in FIG. 4).
4. A series of checks may be performed prior to submersible vehicle release. This is envisaged to be performed when the system is in the status as in any of the positions [j], [i] or [h] in FIG. 4. These checks may include, but are not limited to, vessel-submersible vehicle communication checks, LARS-submersible vehicle interface checks, submersible vehicle control status check and submersible vehicle propulsion check.
5. The towing head 30 releases the submersible vehicle 50. (This step is the transition from status [h] to position [g] in FIG. 4). This step is not applicable to embodiments in which the submersible vehicle 50 is adapted to be connected to the towing arrangement 20 whenever the submersible vehicle is located in said body of water, such as in the case of a towfish.

Alternatively, the submersible vehicle 50 may be released from the towing head 30 without the umbilical 20 being paid out. In that case, the above sequence may skip step 3. FIG. 1 illustrates the system situation just after such launch.

Also, the docking receiver's locking mechanism (if present) may alternatively be unlocked after the series of checks. In that case, the above sequence may be such that action 2 is executed after action 4.

After the above actions, the submersible vehicle 50 is no longer docked to the towing head 30 and the former is deemed launched.

At that point in time, the towing head 30 continues being towed by the vessel 60. The operator can then choose between keeping the towing head in the water or recovering the towing head without the submersible vehicle. The latter recovery may be achieved through actions typically including:

6. The umbilical cable 20 is pulled in by operating the winch 14 in a controlled manner.
7. The distance between the towing head 30 and the docking receiver 13 gradually decreases as the umbilical cable 20 is pulled, until the point where the towing head 30 touches the docking receiver 13. Guided by umbilical cable tension and by the shape of the docking receiver 13 (if the shape is designed for this purpose), the towing head 30 docks to the docking receiver 13.
8. If the docking receiver 13 is equipped with a locking mechanism, this can be locked to secure the towing head 30 docked to the docking receiver 13.
9. The lifting device 10 moves the docking receiver 13, with the towing head 30 docked to it, from submerged position to emerged position (FIG. 2).

At this point, the towing head 30 is deemed recovered and the submersible vehicle 50 is in the water, possibly executing a data acquisition mission. The vessel can here navigate with minimal drag, not towing any object through the water. Alternatively, the lifting device may be kept in the water. A possible reason for keeping the lifting device 10 in the water is to improve communication with the submersible vehicle, particularly in an embodiment where an acoustic transceiver is mounted to the lifting device 10.

For the submersible vehicle 50 to be docked to the towing head 30, they need to take the right position relative to each other. This may include the following:

10. The vessel 60, the submersible vehicle 50 or both determine their positions even at relatively long range using, for example, an ultrashort baseline (USBL) system.
11. The vessel 60, the submersible vehicle 50 or both execute the necessary manoeuvres to align along approximately the same route, being the vessel on the lead and the submersible vehicle on the chase (FIG. 4, status "g").

At this point, the towing head 30 may possibly be in the water, for example if it was not recovered after the last submersible vehicle launch. In case the towing head is not in the water, all necessary actions are undertaken to transfer from its position in or on the vessel to the water, using the lifting device 10,15.

At this point, the towing head 30 is being towed through the water, the vessel and the submersible vehicle are moving along approximately the same route and the vessel is ahead while the submersible vehicle is behind (FIG. 4, status [g]). The system is ready to take actions for docking the submersible vehicle 50 to the towing head 30. These actions may include:

12. The vessel 60 moves forward, ideally at low speed, towing the towing head 30.
13. The towing head 30 moves to the intended docking depth, by gravity or by means of operating its thrusters 34 and/or fins 38. This operation can be remotely operated or completely automated.
14. The vessel operators and/or computer controllers know the position of the submersible vehicle 50, which at this point is moving forward, approximately on the same trajectory and depth as the towing head 30, being the latter 30 ahead of the former 50.
15. Using an acoustic positioning system, one or more underwater cameras, imaging sonar or a combination of these and/or other relevant technologies, the operator and/or computer-based controller of the towing head 30 may continuously perform a series of adjustments in its position relative to the submersible vehicle 50, using its thrusters 34, its fins 37,38, other solutions or a combination of all, to keep itself aligned with the submersible vehicle's nose.
16. Adjusting the velocity of the towing head 30 by vessel 60 speed control, by paid out umbilical 20 length control, using its thrusters 34, or by other means, velocity of the submersible vehicle 50 or yet the velocities of both towing head 30 and submersible vehicle 50 along their approximately coincident trajectory, the distance between the submersible vehicle 50 and the towing head 30 gradually decreases, in a controlled manner. Thus, the nose of the submersible vehicle approaches the towing head.
17. The two previous actions are undertaken continuously and concurrently, until the submersible vehicle and the towing head dock to each other. This is the transition from status [g] to status [h] in FIG. 4 or from status [r] through [s] to [t] in FIG. 10.
18. A locking mechanism 32 on the towing head is actuated and secures the submersible vehicle in place. This can be achieved, for example, with an internal locking mechanism 32 as illustrated in FIG. 6 or with articulated fingers 37 in FIG. 9*b*, with a combination of both, or yet with any other embodiment that performs the same function.
19. The submersible vehicle 50 is at this point safely docked to the towing head 30. If the towing head has a connector 33 and this in turn is equipped with an actuator, the connector 33 moves towards its counterpart 52 at the nose of the submersible vehicle. When both connector halves 33 and 52 touch, or when the distance is sufficiently small, they may start exchanging electric power and/or data. At this point, the connector can be deemed engaged and operable.

Without the need for pulling the towing head 30 (and consequently the submersible vehicle 50 that is at this point docked to it) to the docking receiver 13:

The towing head 30 may supply power (originally supplied by the vessel 60 through the umbilical cable 20) for the submersible vehicle 50 to recharge its batteries;

Data may be transferred in either or both ways between the towing head 30 and the submersible vehicle 50 through their connectors 33, 52. For example, data collected by the submersible vehicle 50 can be transferred to the towing head 30 (and from there to the vessel 60 through umbilical cable 20) and new mission instruction can be transferred from the vessel 60 through the umbilical cable 20 and towing head 30 to the submersible vehicle 50. With reference to FIG. 7, communication between the vessel and the remote operator or a computer-based controller may be achieved via a satellite link 4,5 or a direct communication link 6, for example radio frequency, if the distance is sufficiently small. Yet another variation of the communication link 6 without satellite 70 is via cellular network (e.g. 4G, 5G, etc.) if cellular coverage is present in the area.

With the system in this status (such as in FIG. 4, status [h], [i] or [j]), the vessel may keep navigating, preferably at low speed, while towing the towing head 30 and the submersible vehicle 50 docked to it. It may remain in this status, for example, for the time needed to exchange all necessary power and data between the submersible vehicle 50 and the vessel 60.

The next actions may depend on the overall campaign's needs. For example, the next operation may fall under one of the three possibilities: continued wet tow, submersible vehicle undocking or submersible vehicle recovery.

Continued wet tow may be the case, for instance, if the offshore campaign is to be interrupted. This may be caused, for instance, by bad weather conditions which forces the campaign to be aborted and at the same time making the submersible vehicle recovery to the vessel too difficult and/or too risky. In such situation, the system may remain in this status while the vessel navigates to another location (for example in sheltered waters) while towing the towing head 30 and the submersible vehicle 50 docked to it (FIG. 4, position [h], [l] or [j]). Prolonged wet tow need not be as a contingency, when recovery is not advised or should for example battery reloading be challenging (weak batteries, etc.). Prolonged wet tow may also be an operation mode. This is for example the case adopted for a towfish.

Submersible vehicle undocking may be the case, for instance, if the campaign is to continue with a new submersible vehicle mission. This may typically be achieved with the following actions:

20. The vessel 60 continues moving forward, ideally at low speed.
21. The towing head 30 releases the submersible vehicle 50.

After the above actions, the submersible vehicle 50 is no longer docked to the towing head 30.

In case the submersible vehicle 50 is neither to continue being wet towed nor to be undocked for a new mission, it may be recovered to the vessel 60. This may be the case, for instance, if it is not to start a new mission in the same location and if the weather conditions allow for submersible vehicle recovery to the vessel 60 at acceptable level of difficulty and risk. submersible vehicle recovery may be achieved, typically, with the following actions:

22. The vessel 60 keeps moving forward, ideally at low speed.
23. If the towing head 30 is not yet docked to the docking receiver 13, the umbilical cable 20 is pulled in by turning the winch 14 in a controlled manner.
24. The distance between the towing head 30 (together with the submersible vehicle 50 which is at this point docked to it) and the docking receiver 13 gradually decreases as the umbilical cable 20 is pulled (illustrated in FIG. 4 by the transition from status [h] to status [i]), until the point when the towing head 30 touches the docking receiver 13 (illustrated in FIG. 4 by the transition from status [i] to status [j]. Driven by umbilical tension and by the shape of the docking receiver 13 and its own shape (in case the shapes of the docking receiver 13 and the towing head 30 are designed for this purpose), the towing head 30 docks to the docking receiver 13.
25. If the docking receiver 13 is equipped with a locking mechanism, this may be locked to secure the towing head docked to the docking receiver 13.
26. The lifting device 10 moves the docking receiver 13 from submerged position to another position (possibly on the vessel's deck, as illustrated in FIG. 2 by the transition from position "a" through "b" and "c" to position "d"). At this point, the submersible vehicle 50 is already docked to the towing head 30 and the towing head 30 is already docked to the docking receiver 13, consequently both 50 and 30 move from the water medium to the air along with the docking receiver 13.
27. Optionally, the submersible vehicle 50 and/or the docking receiver 13 are moved to a storage area, for example placing the vehicle on a cradle 62.

At this point in time, the docking receiver 13, towing head 30 and submersible vehicle 50 are all out of the water, possibly on the vessel's deck. Hence, the system is in ideal status for transit, as the vessel can move faster and at lower fuel consumption, free of objects being dragged through the water medium.

As mentioned above, the drag obtained by a sailing marine structure (for example a ship), may for a static marine structure—such as a platform, or a harbour construction—be created by underwater streams.

In an offshore mission, various submersible vehicle missions can be executed. As such, the possibility that this system gives, without taking the submersible vehicle from the water, to recharge its batteries, upload acquired data and download new mission data is of great value.

An illustrative multi-mission campaign may include, for example, the following:

I. Transit from shore to the intended offshore site with the system as illustrated in FIG. 4, situation "k").
II. Launch the submersible vehicle for its first mission by executing actions 1 through to 5.
III. Recover towing head by executing actions 6 through to 9.
IV. Execute submersible vehicle mission.
V. Position the vessel and towing head relatively to the submersible vehicle by executing actions 10 and 11.
VI. Prepare towing head for submersible vehicle docking by executing a series of actions similar to 1,2,3 however without the submersible vehicle docked to the towing head.
VII. Docking the submersible vehicle to the towing head by executing actions 12 through to 19.
VIII. With the submersible vehicle docked to the towing head (being both submerged), the submersible vehicle transfers acquired data to the towing head and the towing head transfers power and new mission data (except at completion of the last mission) to the submersible vehicle.
IX. Undock the submersible vehicle from the docking receiver for new mission by executing actions 20 and 21.
X. Repeat above activities III through to IX again as many times as necessary. At the last submersible vehicle mission, stop at above activity VIII.
Xl. Recover the submersible vehicle to the vessel by executing actions 22 through to 27.
XII. Transit from the offshore site to the harbour, ideally with the system as illustrated in FIG. 4 status [k]. As a contingency, if the submersible vehicle cannot be recovered to the vessel for any reason, the transit can be done wet-towing the submersible vehicle, i.e. with the system as illustrated in FIG. 4, status [h], [i] or [j].

The campaign outlined above is an illustrative example. The system and method described in this invention allows for a multitude of variations in campaign planning and execution.

Glossary (Names of the Items Numbered in the FIGS)

1—Water surface
2—Docking depth
3—Underwater acoustic transmissions
4—Satellite link
5—Satellite-to-operator connection via internet or private network
6—Direct communication between vessel and remote operator
10—Lifting device
11—Articulated arm
12—Hinge
13—Docking receiver
14—Winch
15—Tower
20—Umbilical cable
30—Towing head
31—Towing head's body
32—Locking mechanism
33—Towing head's connector
34—Depth and steering control
35—Towing head's nose
36—Towing head's guiding support system
37—Towing head's fingers
38—Towing head fins
50—Submersible vehicle
51—Submersible vehicle's body
52—Submersible vehicle's connector
53—Submersible vehicle's centreline
60—Vessel
61—Moonpool
62—Cradle for submersible vehicle on the vessel
70—Satellite
80—Operator

The invention claimed is:

1. A surface vessel comprising a launch and recovery system for a submersible vehicle, said surface vessel being adapted to be located in and/or by a body of water, said launch and recovery system comprising:

a towing head comprising an actuatable locking mechanism adapted to lock said submersible vehicle to said towing head, and adapted to release said submersible vehicle from the towing head, a docking receiver, said docking receiver and said towing head being such that they can assume a connected condition in which said towing head is connected to said docking receiver, a towing arrangement adapted to mechanically connect said towing head to said surface vessel, said towing arrangement being adapted to control the distance between said towing head and said docking receiver, and a lifting device, wherein a first portion of the lifting device is connected to said docking receiver, said lifting device being adapted to move said docking receiver relative to said surface vessel, wherein the lifting device is configured to arrange the docking receiver in a towing head receiving and/or releasing position in which:

said docking receiver is completely submerged into said body of water, and said docking receiver is prevented from moving relative to said surface vessel.

2. The surface vessel according to claim 1, wherein said lifting device is such that it is adapted to move said docking receiver from said towing head receiving and/or releasing position to a target position, associated with said surface vessel, along a predetermined fixed trajectory relative to said surface vessel.

3. The surface vessel according to claim 1, wherein said lifting device has a first extension along a first direction, wherein said lifting device is such that it enables movement of said docking receiver relative to said surface vessel along said first direction and prevents movement of said docking receiver relative to said surface vessel along a second direction, perpendicular to said first direction.

4. The surface vessel according to claim 1, wherein said lifting device comprises an articulated arm that is pivotable relative to said surface vessel.

5. The surface vessel according to claim 4, wherein said articulated arm is pivotable relative to said surface vessel around a horizontally extending pivot axis.

6. The surface vessel according to claim 1, wherein said lifting device comprises guide arrangement along which said docking receiver can be imparted a translational movement relative to said surface vessel.

7. The surface vessel according to claim 1, further comprising a loading/unloading station to/from which the submersible vehicle may be moved by the lifting device.

8. The surface vessel according to claim 1, wherein said towing arrangement comprises a cable.

9. The surface vessel according to claim 8, wherein said towing arrangement comprises a cable management arrangement, preferably a winch, adapted to pull in and let out said cable.

10. The surface vessel according to claim 1, wherein said surface vessel is a seagoing vessel adapted to float in said body of water.

11. The surface vessel according to claim 1, wherein said submersible vehicle is an unmanned underwater vehicle.

12. The surface vessel according to claim 1, wherein said locking mechanism is adapted to maintain said submersible vehicle connected to said towing head whenever said submersible vehicle is located in said body of water.

13. A method for recovering a submersible vehicle to a surface vessel adapted to be located in and/or by a body of water, said method comprising:

discharging a towing head from said surface vessel such that it is located in said body of water, said towing head being mechanically connected to said surface vessel via a towing arrangement;

actuating a releasable locking mechanism to lock said submersible vehicle to said towing head;

using a lifting device for arranging a docking receiver in a towing head receiving position in which position:

i. said docking receiver is completely submerged into said body of water, and ii. said docking receiver is prevented from moving relative to said surface vessel;

operating said towing arrangement such that said submersible vehicle and said towing head are moved to said docking receiver such that said towing head and said docking receiver are connected to each other; and using said lifting device for moving said docking receiver, said towing head and said submersible vehicle to an offloading position of said surface vessel.

14. The method according to claim 13, wherein said lifting device is such that it is adapted to move said docking receiver from said towing head receiving and/or releasing position to a target position, associated with said surface vessel, along a predetermined fixed trajectory relative to said surface vessel.

15. The method according to claim 13, wherein said lifting device has a first extension along a first direction, wherein said lifting device is such that it enables movement of said docking receiver relative to said surface vessel along said first direction and prevents movement of said docking receiver relative to said surface vessel along a second direction, perpendicular to said first direction.

16. The method according to claim 13, wherein said lifting device comprises an articulated arm that is pivotable relative to said surface vessel.

17. The method according to claim 13, wherein said lifting device comprises guide arrangement along which said docking receiver can be imparted a translational movement relative to said surface vessel.

18. A method for launching a submersible vehicle from a surface vessel being adapted to be located in and/or by a body of water, said method comprising:

actuating a releasable locking mechanism to lock said submersible vehicle to a towing head;

connecting said towing head to a docking receiver at a loading position of said surface vessel, wherein said docking receiver is connected to a first portion of a lifting device;

using said lifting device for moving said docking receiver, said towing head and said submersible vehicle from said loading position to a towing head launching position in which position:

i. said docking receiver is completely submerged into said body of water, and ii. said docking receiver is prevented from moving relative to said surface vessel;

disconnecting said towing head from said docking receiver;

operating a towing arrangement such that said submersible vehicle and said towing head are moved away from said docking receiver; and disconnecting said submersible vehicle from said towing head.

* * * * *